United States Patent [19]

Kazurov et al.

[11] 4,137,951

[45] Feb. 6, 1979

[54] APPARATUS FOR CONTROLLING ACTUATING MECHANISM OF LOOM DOBBY

[76] Inventors: Alexandr A. Kazurov, Tretya linia, 13, kv. 175; Leonid M. Pevzner, Tretya linia, 13, kv. 6; Alexandra E. Mikhalina, Nagornaya ulitsa, 32, korpus 3, kv. 44, all of Moscow; Nikolai P. Kachkov, ulitsa 50 let Oktyabrya, 18, kv. 42, Cheboxary Chuvashskoi ASSR; Georgy S. Lapshinov, ulitsa Kalinina, 44, Cheboxary Chuvashskoi ASSR, all of U.S.S.R.; Nikolai S. Sedov, prospekt Lenina, 51, kv. 25, Cheboxary Chuvashskoi ASSR; Nikolai P. Kainkov, ulitsa Stroitelei, 9, kv. 31, Losino-Petrovsky Moskovskoi oblasti; Stanislav M. Anisimov, ulitsa Gagarina, 12, kv. 15, Cheboxary Chuvashskoi ASSR, all of U.S.S.R.

[21] Appl. No.: 780,188

[22] Filed: Mar. 22, 1977

[30] Foreign Application Priority Data

Mar. 31, 1976 [SU] U.S.S.R. ..... 2334101

[51] Int. Cl.[2] ..... D03C 1/00

[52] U.S. Cl. ..... 139/68; 139/331

[58] Field of Search ..... 139/66–74, 139/331, 317, 76

[56] References Cited

U.S. PATENT DOCUMENTS

| | | | |
|---|---|---|---|
| 2,085,459 | 6/1937 | Wiget | 139/331 |
| 2,926,703 | 3/1960 | Scheibel et al. | 139/68 X |
| 3,060,975 | 10/1962 | Pfarrwaller | 139/317 |
| 3,554,238 | 1/1971 | Hoenig | 139/68 |

FOREIGN PATENT DOCUMENTS

| | | | |
|---|---|---|---|
| 418580 | 8/1974 | U.S.S.R. | 139/68 |

*Primary Examiner*—James Kee Chi

*Attorney, Agent, or Firm*—Steinberg & Blake

[57] ABSTRACT

The present invention relates to apparatus for controlling the actuating mechanism of a loom dobby and may be most effectively used in looms wherein the heald shafts are raised and lowered by means of continuously-rotating dobbies. This apparatus includes a unit for unit comparing the actual position of the heald shaft with a preset one, whose one input is connected to a program carrier and fed with information on the preset position of the heald shaft, whereas the other input is connected to the output of the actuating mechanism, thereby establishing a feedback coupling, and is fed with information on the actual position of the heald shaft, the output of the comparison unit being connected via a time-delay element to the second input of a logical element whose output is directly connected to the actuating mechanism. This provides for automatic control and matching of the actual and preset positions of the heald shaft.

9 Claims, 10 Drawing Figures

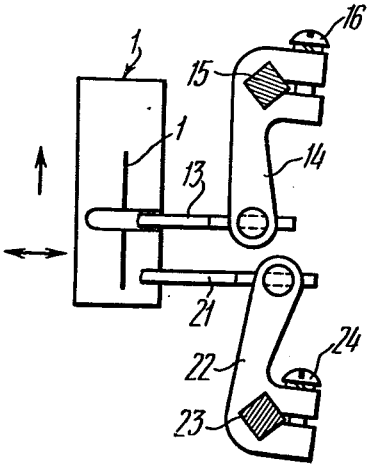
FIG. 3
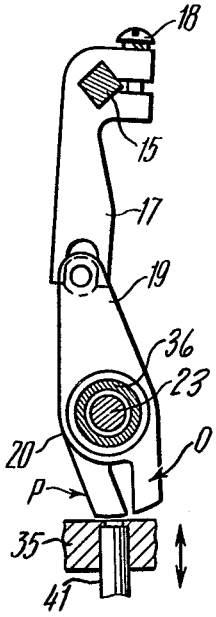
FIG. 4
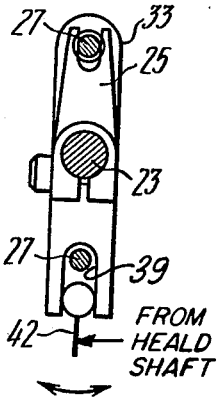
FIG. 5
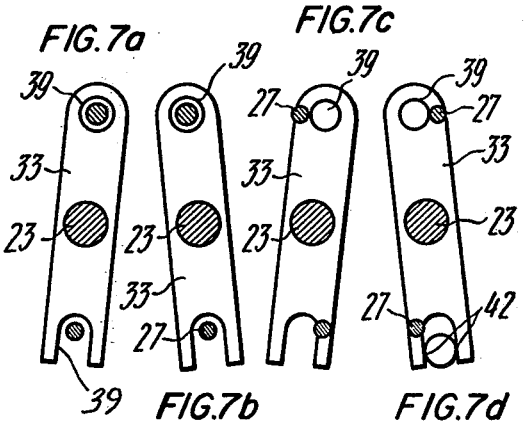

APPARATUS FOR CONTROLLING ACTUATING MECHANISM OF LOOM DOBBY

The present invention relates to looms and, more particularly, to apparatus for controlling the actuating mechanism of a dobby employed thereon.

The present invention can most effectively be used on looms wherein the heald shafts are raised and lowered by means of continuously-rotating dobbies.

At present, there are known apparatus for controlling the actuating mechanism of a dobby, including a programming device with a program carrier and a logical element (cf. U.S. Pat. No. 3,807,460, Cl. 139-76).

In these known apparatus, the program carrier contains only information on a change in the state of the actuating mechanism which, via the logical element, is connected to the programming device and kinematically associated with the heald shaft of the loom. Used as the actuating mechanism is a changeover clutch with rotary keys.

As is known, depending on the preset program of the program carrier, the dobby and, consequently, the actuating mechanism, that is the changeover clutch, may be engaged or disengaged. In this case, the heald shaft coupled with the clutch may rise or fall, thus assuming the upper or the lower position.

In practice, however, depending upon the initial state of the actuating mechanism and depending upon from which card of the pattern repeat readout is started, it is possible to establish, in addition to the required mode of operation of the heald shaft, a number of other modes of operation. This is explained by the fact that the program carrier provides information only on a change in the state of the heald shaft (engaged or disengaged), and not on a change in position thereof (upper or lower).

Thus, in order to provide for a required mode of operation of the heald shaft, it is necessary to manually set a particular (predetermined) state of the actuating mechanism, corresponding to any line (card) of the program carrier. This creates difficulties in loom servicing, involving substantial time losses, which in turn cuts down the loom efficiency.

It is an object of the present invention to provide an apparatus for controlling the actuating mechanism of a loom dobby, wherein a feedback coupling is provided to ensure automatic control and matching of the actual and preset positions of the heald shaft.

Another object of the present invention is to provide an apparatus for controlling the actuating mechanism of a loom dobby, which will be convenient in servicing and reliable in operation.

Still another object of the invention is to provide an apparatus for controlling the actuating mechanism of a loom dobby, which will enhance the quality of the produced cloth.

This and other objects are attained in that in an apparatus for controlling the actuating mechanism of a loom dobby, including a programming device with a program carrier containing information on a change in the state of the actuating mechanism coupled with the heald shaft and, at the same time, with the programming device via a logical element, in accordance with the present invention, there is included a unit for comparing the actual position of the heald shaft with the preset one, one input of which unit is connected to the program carrier and fed with information on the preset position of the heald shaft, and the other input is connected to the output of the actuating mechanism, thereby establishing a feedback coupling, and fed with information on the actual position of the heald shaft, whereas the output of the comparison unit is connected, via a time-delay element, to the second input of the logical element whose output is directly connected to the actuating mechanism. The presence of the comparison unit and the feedback coupling between this unit and the actuating mechanism makes it possible to compare the actual position of the heald shaft with the preset one. The result of comparison is transferred, via the time-delay element, to the logical element which, when operating, causes the actuating mechanism and, consequently, the heald shaft to assume a position corresponding to the preset one. Said operations are performed automatically, which adds to the convenience in loom servicing and increases its efficiency.

For convenience in servicing and ease in manufacture, according to the invention, the program carrier in the programming device is adapted to move longitudinally, upon a change in information, and in a direction towards readout needles which are installed in the immediate vicinity to this program carrier, a control needle being provided to read out information from the program carrier on the preset position of the heald shaft, and a changeover needle reading out, from the program carrier, information on a change in the state of the actuating mechanism, each needle being secured in an individual needle holder which is stationary on a respective shaft, either on the control shaft or on the changeover one.

In a preferred embodiment of the comparison unit, according to the invention, it is made as a fork and a spring-loaded bush with a flange, installed separately on the control shaft so as to be axially movable, the bush being also mounted on the shaft so as to be relatively rotatable andits flange being provided, along the perimeter, with holes for the tines of the fork to automatically pass therethrough whenever the actual positon of the heald shaft is matched with the preset one, the tines thrusting against the flange as soon as the actual position of the heald shaft becomes different from the preset one, thereby causing the bush with the flange to move in the axial direction. Also, according to the invention, the comparison unit includes a crank-arm rigidly installed on the same shaft, kinematically associated with the fork and turning together with the shaft in accordance with the position of the control needle.

According to the invention, the time-delay element represents a latch thrusting against the bush with the flange as soon as there appears a discrepancy between the actual position of the heald shaft and the preset one, thereby fixing said bush with the flange in an axially displaced position.

It is also preferable that the logical element in the proposed apparatus be made as a bush carrying stops on the outer surface, arranged in a staggered manner, this bush being installed on that of the comparison unit coaxially therewith and adapted to move in the axial direction together with and to turn around this bush, the bush of the logical element being also provided with a pin-and-slot transmission kinematically associated with the crank-arm stationary on the changeover shaft of the programming device turning the logical element depending on the position of the changeover needle.

The feedback coupling, according to the invention, is a leverage connecting the flange of the bush of the comparison unit to the element of the actuating mechanism determining the actual position of the heald shaft.

Given below is a detailed description of the present invention with reference to the accompanying drawings, wherein:

FIG. 3 is a section view along line III—III in FIG. 2;

FIG. 4 is a section view along line IV—IV in FIG. 2;

FIG. 5 is a section view along line V—V in FIG. 2;

FIGS. *7a, 7b, 7c, 7d* show various mutual positions of comparison unit elements.

Figure 1:
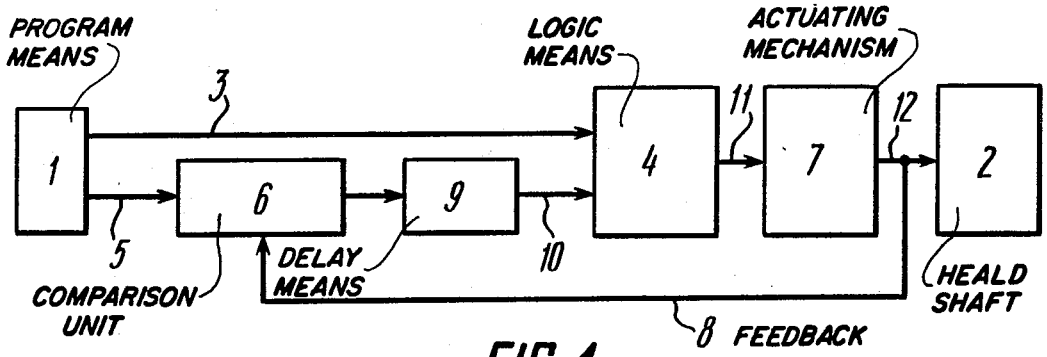
FIG. 1 is a block diagram of an apparatus for controlling the actuating mechanism of a loom dobby.

The proposed apparatus for controlling the actuating mechanism of a loom dobby comprises a programming device with a program carrier 1 (FIG. 1) containing information on a change in both the state and position of a heald shaft 2, and having two outputs. One output delivering information on a change in the state of the heald shaft 2 via a coupling 3 is directly connected to a logical element 4, whereas the second output delivering information on a preset position of the heald shaft 2 is connected via a coupling 5 to a comparison unit 6. Besides, the input of the comparison unit 6 is connected to the output of an actuating mechanism 7 of the dobby via a feedback coupling 8. The output of the comparison unit 6 is connected via a time-delay element 9 and a coupling 10 to the logical element 4. The output of the logical element 4 is connected through a coupling 11 to the actuating mechanism 7 which, in turn, through a coupling 12, is connected to the heald shaft 2 of the loom.

The program carrier 1 is a punched tape (not shown) adapted to move longitudinally upon a change in information.

Figure 2:
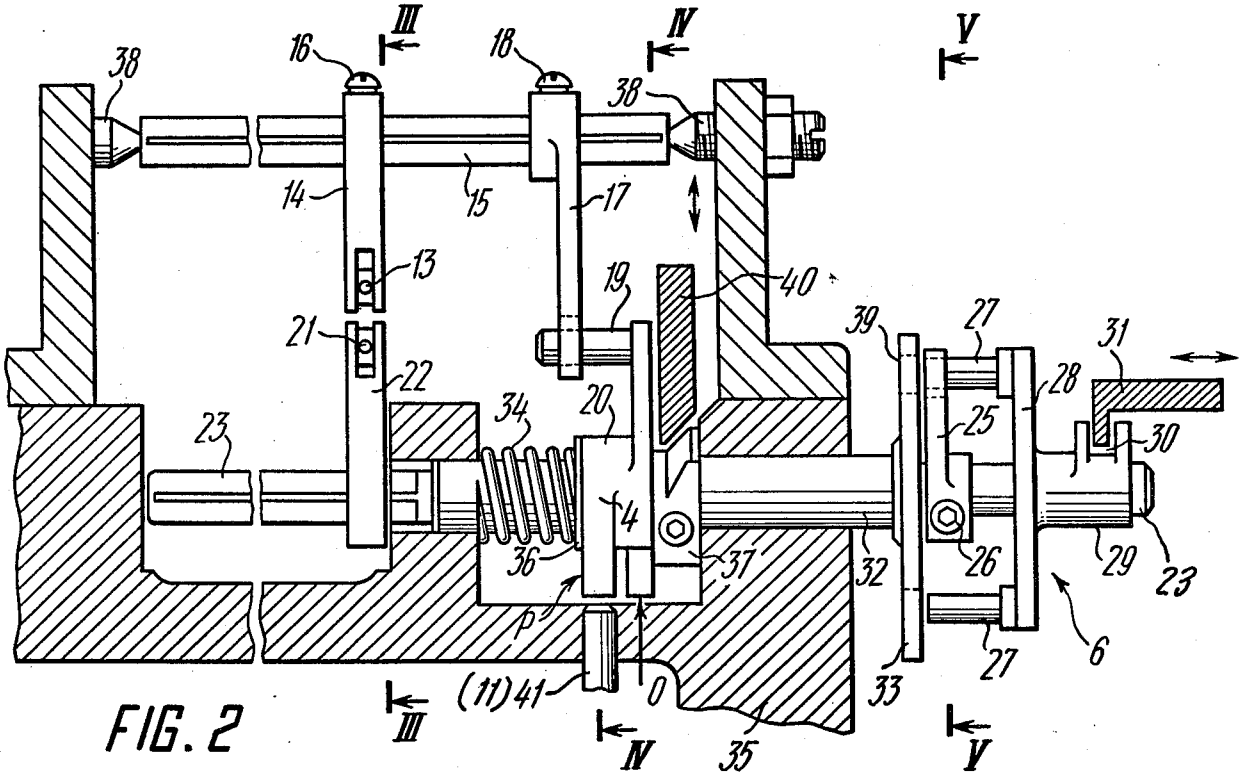
FIG. 2 is a side view of an alternative embodiment of the proposed control apparatus, partially in section.

The kinematic coupling 3 between the program carrier 1 and the logical element 4 is a readout changeover needle 13 (FIG. 2) placed in a needle holder 14 secured on a change-over shaft 15 with the aid of a screw 16. This needle 13 serves to read out, from the punched tape, information on a change in the state of the actuating mechanism 7. The shaft 15, through the medium of a crank-arm 17 secured on this shaft by means of a screw 18, is coupled by a slot in arm 17 with a pin of a pin carrier 19 with a bush 20 of the logical element 4. Thus it will be seen that the pin carrier 19 is in the form of an arm integral with the bush 20 and carrying a pin which is received in the slot of the arm 17 so as to provide in this way a pin-and-slot transmission between the arm 17 and the bush 20.

The kinematic coupling 5 (FIG. 1) between the program carrier 1 and the comparison unit 6 includes a readout control needle 21 (FIG. 3) placed in a needle holder 22 secured on a control shaft 23 with the aid of a screw 24. This needle 21 serves to read out, from the program carrier 1, information on the preset position of the heald shaft 2. The shaft 23 (FIG. 2), through the medium of a crank-arm 25 secured on this shaft by means of a screw 26, is coupled with a tine 27 of a fork 28 of the comparison unit 6, the fork 28 being installed on the control shaft 23 so as to be turnable and axially movable thereon. In a tubular shank 29 of the fork 28, there is made a slot 30. Through this slot 30 and an angle-piece 31, the fork 28 is coupled with the main shaft of the dobby (not shown) to be cyclically reciprocated back and forth, as shown by the double-headed arrow at the right of FIG. 2.

The comparison unit 6 includes, in addition to the fork 28, a bush 32 with an elongated flange 33 also installed on the shaft 23 and acted on by a spring 34. This bush is support for turning movement by and extends into a housing 35 against which one end of the spring 34 abuts. The other end of this spring thrusts against one of the end faces of a bush 36. This bush 36 is set in the bush 20 of the logical element 4 and thrusts with the other end face against a shoulder 37 of the bush 32 of the comparison unit 6, the shoulder 37 bearing up against the housing 35. Installed in this housing are centers 38 wherein the changeover shaft 15 is rotatably arranged. The shaft 23 is supported for rotation in an opening of the wall of housing 35 against which one end of the spring 34 presses as well as in the interior of the bush 32, this shaft 23 also extending through the tubular shank 29 of the fork 28 so as to support the latter also for turning and axial movement. Made on the flange 33 of the bush 32, at opposed end regions thereof, are holes 39 whereinto the tines 27 of the fork 28 automatically run when the actual position of the heald shaft 2 is matched with the preset one. As soon as a discrepancy appears between the actual position of the heald shaft 2 and the preset position thereof, the tines 27 thrust against the flange 33 of the bush 32.

The time-delay element 9 is essentially a latch 40 coupled with the main shaft of the dobby to be reciprocated vertically thereby as shown by the double-headed arrow and thrusting against the bush 32 via the shoulder 37 when there is a discrepancy between the actual and the preset positions of the heald shaft 2. The bushes 32 and 36, the spring 34 and the shoulder 37 make up a kinematic coupling 10 between the comparison unit 6 and the logical element 4.

The bush 20 of the logical element 4 is coaxially mounted on the bush 36 of the comparison unit 6 so as to be axially movable together with and rotatable around this bush. On the bush 20, two stops "P" and "O" are arranged in a staggared manner. Associated with these stops is a rod 41 (FIG. 4) which is coupled with the main shaft of the dobby and used as a kinematic coupling 11 between the logical element 4 and the actuating mechanism 7.

The output of the actuating mechanism, i.e. the element determining the position of the heald shaft 2 at any moment of the operating cycle of the dobby, via a leverage 42 (FIG. 5) which is essentially the feedback coupling 8, is connected to the flange 33 of the bush 32 of the comparison unit 6.

Figure 6:
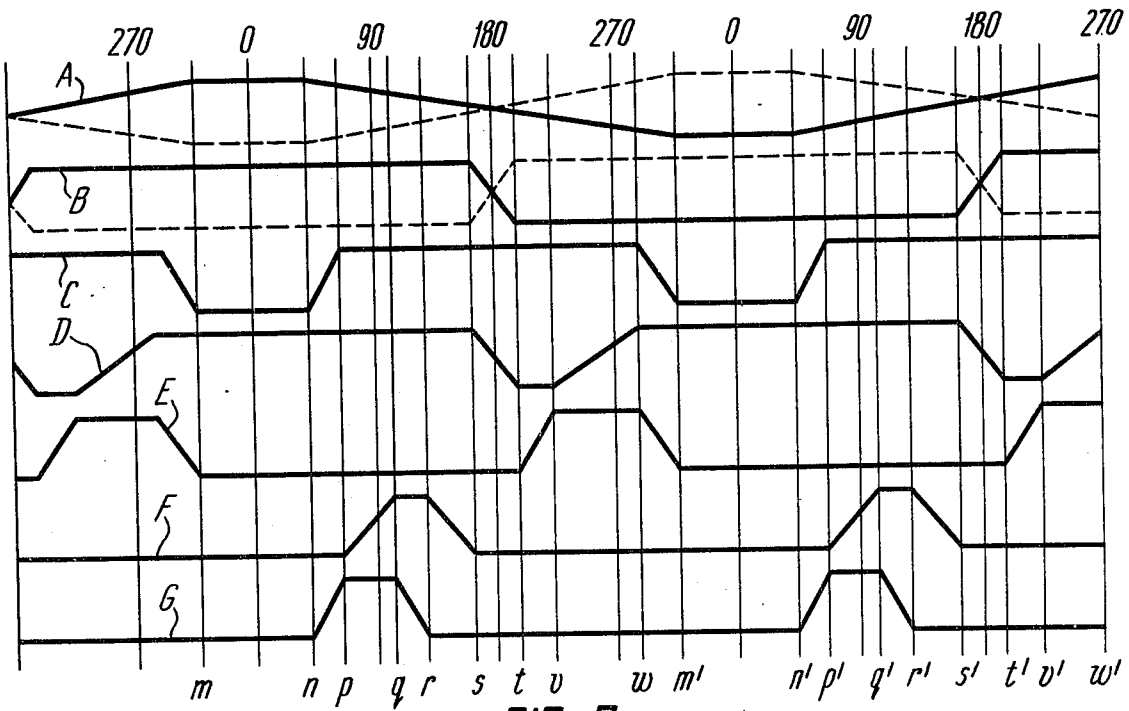
FIG. 6 is a cyclogram of operation of a dobby.

Within each operating cycle of the dobby, the program carrier 1 acts upon the readout needles 13 and 21 in accordance with curve "E" on a cyclogram (FIG. 6) and by moment "m" transmits, through the kinematic coupling 3, a signal to the logical element 4 thereby placing the latter relative to the rod 41 in an angular position corresponding to the information on a track of the program carrier 1 wherewith the changeover needle 13 cooperates. In what follows, for brevity, this track will be referred to as "changeover track." At the same time, the program carrier 1, via the kinematic coupling 5, transmits a signal to the fork 28 of the comparison unit 6 placing it relative to the flange 33 of the bush 32 in a position corresponding to the information on the track of the program carrier 1 with which the control needle 21 cooperates. For brevity, this track will be referred to hereinbelow as "control track."

Therewith, the flange 33, in turn, is placed by the actuating mechanism 7 via the feedback kinematic coupling 8 in a position corresponding to the actual position of the heald shaft 2.

Within the interval between moments "m" and "n", in accordance with curve "C" (FIG. 6), the logical element 4 interacts via the kinematic coupling 11 (rod 41) with the actuating mechanism 7 whereby the state of the heald shaft 2 is either changed or remains unchanged. After moment "m," four cases are possible:

(1) the heald shaft is engaged and depressed (moves upwards);
(2) the heald shaft is disengaged and lifted (dwells in the upper position);
(3) the heald shaft is disengaged and depressed (dwells in the lower position);
(4) the heald shaft is engaged and lifted (moves downwards).

For illustration and clarity, all four possible cases of the position and state of the heald shaft, when operating in a required mode, are indicated in Table 1.

In this table, numerals I, II, III through XI in the first column denote operating cycles of the dobby. In column "a" are indicated the preset positions of the heald shaft, the shaded squares corresponding to the upper position of the shaft and the unshaded ones corresponding to the lower position thereof. Registered in column "b" is information of the program carrier read out by the control needle 21, i.e. the control track. Registered in column "c" is information of the program carrier read out by the changeover needle 13, i.e. the changeover track. Entered into columns "$d_1$", "$d_2$", "$d_3$" and "$d_4$" are the results of comparison of the actual position of the heald shaft with the preset one, and, if the actual position of the heald shaft is matched with the preset position, the meaning of the information on the changeover track (column "c") remains what can be termed as "direct," i.e. the presence of a hole on the punched tape corresponds to the presence of a change-over (a change in the state of the actuating mechanism 7), the absence of a hole corresponds to the absence of a change-over. This result of comparison is conventionally indicated by the word "direct."

When the actual position of the heald shaft differs from the preset one, the meaning of information of the changeover track (column "c") during the next operating cycle of the dobby is opposite, i.e. the presence of a hole corresponds to the absence of a change-over, the absence of a hole corresponds to the presence of a change-over. This result of comparison is conventionally indicated in the table by the word "reverse."

Table 1

| | a | b | c | $d_1$ | $e_1$ | $f_1$ | $d_2$ | $e_2$ | $f_2$ | $d_3$ | $e_3$ | $f_3$ | $d_4$ | $e_4$ | $f_4$ |
|---|---|---|---|---|---|---|---|---|---|---|---|---|---|---|---|
| I | | 0 | 0 | direct | eng. | | direct | diseng. | | direct | diseng. | | direct | eng. | |
| II | | | | reverse | diseng. | | direct | diseng. | | reverse | eng. | | direct | eng. | |
| III | | 0 | 0 | reverse | diseng. | | reverse | diseng. | | direct | diseng. | | direct | diseng. | |
| IV | | 0 | | direct | diseng. | | direct | diseng. | | direct | diseng. | | direct | diseng. | |
| V | | 0 | 0 | direct | eng. | | direct | eng. | | direct | eng. | | direct | eng. | |
| VI | | | | direct | eng. | | direct | eng. | | direct | eng. | | direct | eng. | |
| VII | | 0 | | direct | eng. | | direct | eng. | | direct | eng. | | direct | eng. | |
| VIII | | | | direct | eng. | | direct | eng. | | direct | eng. | | direct | eng. | |
| IX | | 0 | 0 | direct | eng. | | direct | diseng. | | direct | eng. | | direct | diseng. | |
| X | | 0 | | direct | eng. | | direct | diseng. | | direct | eng. | | direct | diseng. | |
| XI | | 0 | | direct | diseng. | | direct | diseng. | | direct | diseng. | | direct | diseng. | |

In columns "$E_1$", "$E_2$", "$e_3$", "$e_4$", conventionally shown is the condition of the heald shaft: engaged or disengaged, and in columns "$f_1$", "$f_2$", "$f_3$", "$f_4$" are shown the actual positions of the heald shaft, the shaded square showing the upper position, the non-shaded square, the lower position.

Let us now consider the process of automatic adjustment of the dobby to fit the given pattern referring to the first variant of position of the heald shaft 2, i.e. when within the first cycle, after moment "n" (FIG. 6), the heald shaft 2 is engaged and depressed (Table 1, position I-$e_1$, position I-$f_1$). As can be seen from the table, during the first operating cycle the heald shaft should be lifted (position I-a). Thus, the actual position of the heald shaft does not correspond to the present one. In this case, the fork 28 and the flange 33 of the comparison unit 6 are set relative to each other as is shown in FIG. *7c*, i.e. the tines 27 do not run into the holes 39 of the flange 33.

From moment "p" (FIG. 6) on the angle-piece 31 starts shifting (curve F of FIG. 6) the fork 28 towards the flange 33 and the tines 27, while thrusting against the flange 33, start shifting the entire system: the flange 33 — the bush 32 — the shoulder 37 — the bush 36 and the logical element 4, thereby compressing the spring 34. Now, into the zone of action of the rod 41 comes the stop "O" of the logical element 4 whereby the meaning of the information of the change over track of the program carrier gets inverted (becomes reverse) because of the stops "P" and "O" (see FIGS. 2 and 4) being arranged in a staggered manner. By moment "q" (FIG. 6), the axial displacement of the mentioned-above system ceases and during the time interval between moments "q" and "r" the latch 40 falls down (curve G of FIG. 6), thereby occupying the space between the shoulder 37 and the housing 35. As a result, the above system in its entirety is retained in a shifted position even though the angle-piece 31 shifts (curve F of FIG. 6) the fork 28 by moment "s" to the initial position. Then, since during the first cycle the heald shaft 2 is engaged (Table 1, position I-$e_1$) and moves upwards, during the time interval between moments "s" and "t," (FIG. 6) the flange 33 changes (curve B of FIG. 6) its position for an opposite one. During the same time interval (from "s" to "t"), the program carrier 1 executes its motion (curve D of FIG. 6) away from the readout needles (13, 21), after which, during the time interval from moment "t" to moment "v," the program carrier 1 moves (curve E of FIG. 6) longitudinally by one card, thereby setting new changeover and control tracks against respective needles. In the time interval from moment "v" to moment "w," the program carrier 1 moves towards the readout needles 13, 21 and, since in the changeover card of the second cycle there is no hole (Table 1, position II-c) and the logical element 4 is held by the latch 40 in the shifted position, the stop "O" is set against the rod 41, i.e. the "reverse" signal (Table 1, position II-d) is initiated.

Thus, in the time interval m'-n' (FIG. 6), a change in the state (curve C) of the heald shaft occurs, which means that during the second cycle precisely it is disengaged and lifted (Table 1, position II-$e_1$, position II-$f_1$).

Since, during the second cycle, the actual position of the heald shaft does not comply with the preset position, after moment "q" (FIG. 6) the logical element 4 is in the shifted position, i.e. the stop "O" is within the zone of action of the rod 41 which means that during the third cycle (Table 1, position III-$d_1$) the meaning of the information on the change-over track remains "opposite", that is when there is a hole in the changeover track and the logical element 4 is in the shifted position, the stop "O" is removed from the line of action of the rod 41 and during a time period m''-n'' (equal to the time interval m'-n' in FIG. 6) the state of the heald shaft remains unchanged.

Thereafter, during the third operating cycle, the heald shaft is disengaged and lifted (Table 1, position III-$e_1$, position III-$f_1$). Since, during this cycle, the actual position of the heald shaft coincides with the preset one, i.e. the heald shaft should be and is lifted (Table 1, position III-a), the mutual arrangement of the fork 28 and of the flange 33 of the bush 32 is as that shown in FIG. 7*b*. In this case, the tines 27 coincide with the holes 39 of the flange 33 and the fork 28, while moving (the curve F of FIG. 6), leaves the flange 33 and the logical element 4 coupled therewith in the initial position, i.e. in a position when the stop "P" of the logical element 4 is within the zone of action of the rod 41. Therewith, the meaning of the information of the changeover track of the program carrier 1 is "direct" (Table 1, position IV-$d_1$). Since during the fourth cycle there is no hole in the changeover track of the program carrier 1 (Table 1, position IV-c), then, by a moment $m^{III}$ (similar to moment m' in FIG. 6) the stop "P" proves to be removed from the line of action of the rod 41. During a time interval $m^{III}$-$n^{III}$ (equal to time interval m'-n' in FIG. 6), no change-over occurs and during the fourth cycle the heald shaft is disengaged and assumes an upper position which corresponds again to the preset position thereof.

Sequentially, the heald shaft operates in a stable mode when during each cycle the holes of the flange 33 coincide with the tines 27 of the fork 28 of the comparison unit 6, as is shown in FIGS. 7*a* and 7*b*, the meaning of the information of the changeover track of the program carrier 1 remaining "direct".

Thus, it will be seen that the above-described structure of the invention forms an apparatus which is adapted to control the actuating mechanism of a loom dobby, this apparatus including a logic means 4 formed by the bush 20 which is supported by a support means which includes the bush 36 and the shaft 23 extending therethrough. This support means supports the logic means for movement between a normal location, shown in FIG. 2, and a displaced location in which the stop O is situated in the plane of the output means 41. The output means 41 of the logic means 4 is operatively connected in a known way to a heald shaft for controlling the position thereof. In both its normal and its displaced locations, the logic means 4 is capable of being placed in first or second angular positions by way of the program-responsive means formed by components 13–19, this program-responsive means being operatively connected with the logic means 4 to place the latter in either its first or second angular position depending upon the information at the punched card of the program means. In its normal location shown in FIG. 2, the stop P of the logic means is in line with the output means 41 so as to provide one type of operation therethrough, in this first angular position of the logic means 4 while it is in the illustrated normal location. In its second angular position, while in its normal location, the stop P will be turned beyond the output means 41 so that a second type of operation will be provided therethrough. On the other hand, when the logic means 4 is in its displaced location, then when it is in its first angular position the stop O is situated angularly beyond the output means 41, so that the second type of operation is provided therefor even though the logic means 4 is still in its first angular position. On the other hand, when the logic means is in its displaced location and in its second angular position, the stop O will be in line with the output means 41 so as to provide the first type of operation therefor. Thus, it is apparent that when the logic means is in its normal location, in its first and second angular positions it will provide a first and second type of operation for the output means 41, whereas when the logic means 4 is in its displaced location the logic means 4 in its first and second angular positions will provide the second and first type of operation for the output means 41. In this way by shifting the logic means 4 to its displaced location the information received from the program means by way of the program-responsive means 13–19 is reversed.

The fork 28 of the comparison unit 6 forms a sensing means for sensing the actual position of the heald shaft. This sensing means 28 is operatively connected with the cyclically operating means 31 to be cyclically moved thereby along a given path of movement. The components 21–23 and 25–27 form a second program-responsive means operatively connected to the sensing means 28 for placing the latter in either one of at least a pair of predetermined angular positions, in accordance with the particular information which is received by this second program-responsive means from the program means. The elongated flange 33 together with its tubular bush 32 forms an indicating means operatively connected with the element controlled by the output means 41, namely the heald shaft, to indicate the actual position thereof. This indicating means 33 is automatically positioned, by way of the transmission which includes the component 42 shown in FIG. 5, in either one of at least a pair of positions which will respectively either register with the position of the sensing means 28 or will not register therewith. This indicating means 33 is situated along the path of movement of the sensing means 28 in such a way as to remain out of engagement therewith when the indicating means 33 is in the position registering with the position of the sensing means 28. However if the indicating means 33 is in a non-registering position with respect to the sensing means 28, then when the latter is cyclically moved along its path of movement by the means 31, the sensing means 28 will through its tines 27 displace the indicating means 33, and this indicating means 33 is operatively connected through its bush 32 and flange 37 with the logic means 4 so as to displace the latter from its normal location to its displaced location. The spring 34 of course forms a spring means for yieldably maintaining the logic means in its normal location. The delay means 9 formed by the reciprocating latch 40 cooperates with the flange 37 for temporarily maintaining the logic means 4 in its displaced location so that the information transmitted to the logic means 4 by way of the first program-responsive 13–19 will be reversed as described above. After a given cycle of operation the delay means releases the logic means to be returned by the spring means 34 back to its normal location.

What is claimed is:

1. An apparatus for controlling the actuating mechanism of a loom dobby for raising and lowering heald means, comprising: support means, logic means supported by said support means for movement between normal and displaced locations, said logic means also being supported by said support means for movement between first and second positions in each of said locations, first program-responsive means for responding to a predetermined program and operatively connected with said logic means for situating the latter either in said first or said second position thereof both when said logic means is in said normal location thereof and when said logic means is in said displaced location thereof, output means operatively connected to actuating means of the loom dobby cooperating with said logic means to be controlled thereby, said logic means when in its normal location providing in its first and second positions first and second types of operation, respectively, of said output means and said logic means when in its displaced location providing in said first and second positions thereof, said second and first types of operation, respectively, at said output means, so that the information transmitted to said output means through said logic means from said first program-responsive means is reversed when said logic means is in its displaced location as compared with the information transmitted when said logic means is in its normal location, sensing means for sensing the position of heald means, controlled by a mechanism actuated by said output means, moving means operatively connected with said sensing means for moving the latter cyclically along a predetermined path of movement, second program-responsive means for responding to a predetermined program and operatively connected with said sensing means for situating the latter in either one of at least a pair of predetermined positions, indicating means adapted to be operatively connected with said heald means controlled by the mechanism actuated by said output means for indicating the actual position of said element, said indicating means having, according to the actual position of said element, either a registering position in register with the position of said sensing means or a non-registering position out of the register with the position of said sensing means, and said indicating means being supported for movement by said support means and being situated out of the path of movement of said sensing means when said indicating means has said registering position with respect thereto and in the path of movement of said sensing means when said indicating means is in a non-registering position with respect to said sensing means, so that when said indicating means is in said non-registering position said indicating means will be moved by said sensing means, said indicating means being operatively connected with said logic means for moving the latter from said normal to said displaced location thereof when said indicating means is moved by said sensing means, and delay means cooperating with said logic means for releasably holding the latter is said displaced location thereof for an interval sufficient for the information transmitted by said first program-responsive means though said logic means to said output means to be reversed.

2. The combination of claim 1 and wherein a spring means cooperates with said logic means for yieldably urging the latter toward said normal location, said delay means holding said logic means in said displaced location in opposition to said spring means until said delay means releases said logic means for return to said normal location by said spring means.

3. The combination of claim 1 and wherein said support means supports said logic means for axial movement along a predetermined axis between said normal and displaced locations thereof and for angular movement about said axis between said first and second positions thereof.

4. The combination of claim 3 and wherein said output means includes a member movable back and forth along a second axis perpendicular to said predetermined axis, said logic means having a first stop situated along said second axis in the path of movement of said member when said logic means is in said normal location thereof and in said first position thereof and situated beyond said second axis out of the path of movement of said member when said logic means is in said normal location and in said second position thereof, said logic means having a second stop axially and angularly displaced with respect to said first stop and situated along said second axis in the path of movement of said member when said logic means is in said displaced location thereof and in said second position thereof while being situated beyond said second axis out of the path of movement of said member when said logic means is in said displaced location and in said first position thereof.

5. The combination of claim 4 and wherein said first program-responsive means includes a pin having a position determined by a structure such as a punched card of a program means, a lever fixedly carrying said pin, a rotary shaft fixedly carrying said lever to assume an angular position determined by said pin, a second lever fixed to said shaft for rotary movement therewith, and a pin-and-slot transmission connecting said second lever to said logic means for turning the latter to said first or second position thereof either when said logic means is in said normal location thereof or in said displaced location thereof.

6. The combination of claim 4 and wherein said second program-responsive means includes a pin adapted to be controlled by a structure such as a punched card of a program means, a lever fixedly carrying said pin, a rotary shaft fixedly carrying said lever to assume an angular position determined by the position of said pin, said rotary shaft forming part of said support means and extending through said indicating means to support the latter for movement as well as through said sensing means to support the latter for reciprocating movement along said path of movement thereof, said rotary shaft being turnable with respect to said indicating means and fixedly carrying a crank which is formed with an opening passing therethrough, said sensing means including a fork having a tine situated in said opening of said crank so that the angular position of said sensing means is determined by said second program-responsive means, said tine being axially movable through said opening of said crank and said indicating means being situated in the path of movement of said tine when said indicating means is in said non-registering position thereof, said logic means including a bush through which said rotary shaft extends, the axis of said rotary shaft coinciding with said predetermined axis, and said indicating means having an end portion in engagement with said bush of said logic means for moving the latter from said normal to said displaced location thereof along said rotary shaft when said indicating means is moved by said tine of said sensing means.

7. The combination of claim 6 and wherein said indicating means includes a tubular portion through which said rotary shaft extends, said tubular portion of said indicating means terminating at one end in a flange which forms said end portion of said indicating means which engages said bush of said logic means, said support means also including a housing having an opening in which said tubular portion of said indicating means is supported for angular and axial movement, and spring means cooperating with said bush of said logic means for urging the latter to said normal location thereof, said bush when in its normal location situating said flange of said indicating means against a wall portion of said housing.

8. The combination of claim 7 and wherein when said indicating means is in said non-registering position with respect to said sensing means, the latter displaces said indicating means to situate said flange beyond said housing to define a predetermined space therewith, and said delay means including a latch element which becomes situated in said space to prevent return of said logic means to said normal position thereof by said spring means until said latch element is moved out of said space.

9. The combination of claim 8 and wherein said sensing means and indicating means cooperate together to form a comparison unit, said second program-responsive means forming a first input to said comparison unit and the position of said indicating means forming a second feedback input to said comparison unit, said comparison unit acting through said delay means for providing one of a pair of inputs of said logic means, and said first program-responsive means providing the second of said pair of inputs to said logic means, so that the control of said output means by said logic means is determined in accordance with the pair of inputs to said logic means.

* * * * *